US005564294A

United States Patent [19]

Chen

[11] Patent Number: 5,564,294

[45] Date of Patent: Oct. 15, 1996

[54] MUSICAL DOOR LOCK

[76] Inventor: Lai-Fa Chen, Suite 1, 11 Fl. No. 95-8, Chang Ping Road Sec.1, Taichung, Taiwan

[21] Appl. No.: 313,444

[22] Filed: Sep. 27, 1994

Related U.S. Application Data

[63] Continuation of Ser. No. 62,197, May 17, 1993, abandoned.

[51] Int. Cl.[6] ..... E05B 9/02

[52] U.S. Cl. ..... 70/1; 70/432; 70/448; 70/DIG. 49; 340/328

[58] Field of Search ..... 70/448, 432, 1, 70/224, DIG. 49; 116/DIG. 12; 340/542, 328, 330, 693

[56] References Cited

U.S. PATENT DOCUMENTS

| | | | |
|---|---|---|---|
| 2,295,482 | 9/1942 | Kemp | 340/542 |
| 3,704,460 | 11/1972 | Frank | 340/542 |
| 3,714,643 | 1/1973 | Sosin et al. | 340/542 |
| 4,196,422 | 4/1980 | Swigert et al. | 340/542 |
| 4,633,232 | 12/1986 | Nelson et al. | 340/542 |
| 4,852,922 | 8/1989 | Shih | 70/467 X |
| 4,981,314 | 1/1991 | Carr | 292/347 |
| 5,027,629 | 7/1991 | Liu | 70/224 X |
| 5,311,168 | 5/1994 | Pease, Jr. et al. | 340/542 |
| 5,365,214 | 11/1994 | Angott et al. | 340/328 |

FOREIGN PATENT DOCUMENTS

| | | | |
|---|---|---|---|
| 2510170 | 1/1983 | France | 340/542 |

*Primary Examiner*—Lloyd A. Gall

[57] ABSTRACT

A musical door lock comprises a generally rectangular housing having enclosed therein door lock, an electric door bell and a battery chamber. When a push-button on the outer periphery is pressed to actuate a sound generator inside the housing, the combined electric door bell will release a musical melody or the sound of bird chirps inside the door. A second example provides a frequency regulator instead of a sound generator incorporated with a movable wireless door bell that offers more convenience to the house owners. In addition an anti-burglar device combine with the lock mechanism for releasing a warning signal which may be received by a portable radio receiver. This disclosure is characteristically providing an economical utility of space in a door lock as well as its variety of functions.

5 Claims, 4 Drawing Sheets

MUSICAL DOOR LOCK

BACKGROUND OF THE INVENTION

This is a continuation application of U.S. patent application Ser. No. 08/062,197, filed on May 17, 1993, now is abandoned.

The present invention relates to door locks, more particularly to a musical door lock which is a combination of a door lock and an electric door belt that can produce multiple effectiveness as a security and an alarming system.

Both of a door lock and a door bell are indispensable every household and both of them has been greatly improved along with the progression of the science and technology. People are not only seeking for their substantial applicability but also their cosmetic effects. That is why the door lock and the door bell designs are varied internally and externally in every household. They become the most essential aspects among other details in house construction. Engineers customarily layout a special wiring diagram among the other distributing systems for the installation of an electric door bell during design stage. People have customarily accept, ed that a door belt is a part of their house and don't care how much it costs or what space it occupies in their houses. What they care about is the type as well as the sound of a bell. They most prefer a musical melody or birds chirping which not only alerts them but also amuzes them.

However, to separately install a door bell in a house presents at least the following disadvantages:

1) it occupies a certain amount of the electric distribution system in a house construction.

2) it occupies a certain space among other installations in a house, and 3) once the wiring system fails, it is difficult to repair. Sometimes, needs to pierce through the wall or the ceiling cause damage to a house.

SUMMARY OF THE PRESENT INVENTION

The main object of the present invention is to provide a musical door lock of which is a door lock structurally combined with a musical door bell to produce double effectiveness and to facilitate a ready installation and repair. Furthermore, it saves the space and time for separate installation of a door bell in a house. Accordingly, the present invention of a musical door lock comprises generally a door locking assembly having a rectangular housing enclosing a door lock on the upper portion, an electric door bell on the middle portion and batter chamber on the lower portion therein.

The rectangular housing as two arched ends, connected to a enclosed lateral wall and a two arched ends covers. Flanges are extended outward from the bottom edges of the housings and the cover for securing the lock assembly onto a door. The door lock has lock bar perpendicularly extended through the upper portion of the housing, a pair of hand knobs rotatably secured to the ends of the lock bar and a spring door latch slidingly extruded from lateral wall of the housing. The electric door bell has a sound generator, a push-button operatably secured to the outer periphery of the bottom of the housing and a speaker secured to the outer periphery of the cover. The battery chamber has a lid openably located on the outer periphery of the cover. The musical door lock assembly is disposed to a door as he same of other door locks and a pleasant musical, melody or the sound of bird chirps is released upon pushing, on the but ton outside the assembly.

A second example is a radio type door bell provided with a door lock which comprises a frequency regulator disposed within the middle portion of the housing instead of the sound generator at the middle portion inside the housing and a movable sound member in a casing in which includes a frequency receiver, a sound generator, a speaker, a rechargeable battery chamber, a transformer and a pair of plus blades in order that the movable sound member can be run on either ac or dc current. A light bulb releasably secured at a tapering groove on the top incorporated with a sliding switch on a lateral side of the sound member provide a broader function for it.

An anti-burglar device is provided incorporating with the locking mechanism of the door lock. A spring plate is disposed at the perpendicular point of a key aperture and the spring latch of the door lock and respectively connected with a setting button on the outer periphery of the housing. Generally, when a key is inserted in the key aperture, the spring plate will be operated by a rotary movement of the key to actuate the sound generator to release a warning sound or to actuate a freguency regulator the second example to produce a predetermined frequency which can be remotely received by the movable wireless door bell or a portable radio receiver in a certain distance.

Further objects and advantages will become more apparent in a consideration to read the description in accompanying with the attached drawings.

DETAIL DESCRIPTION OF THE PREFERRED EMBODIMENT OF THE PRESENT INVENTION

Figure 2:
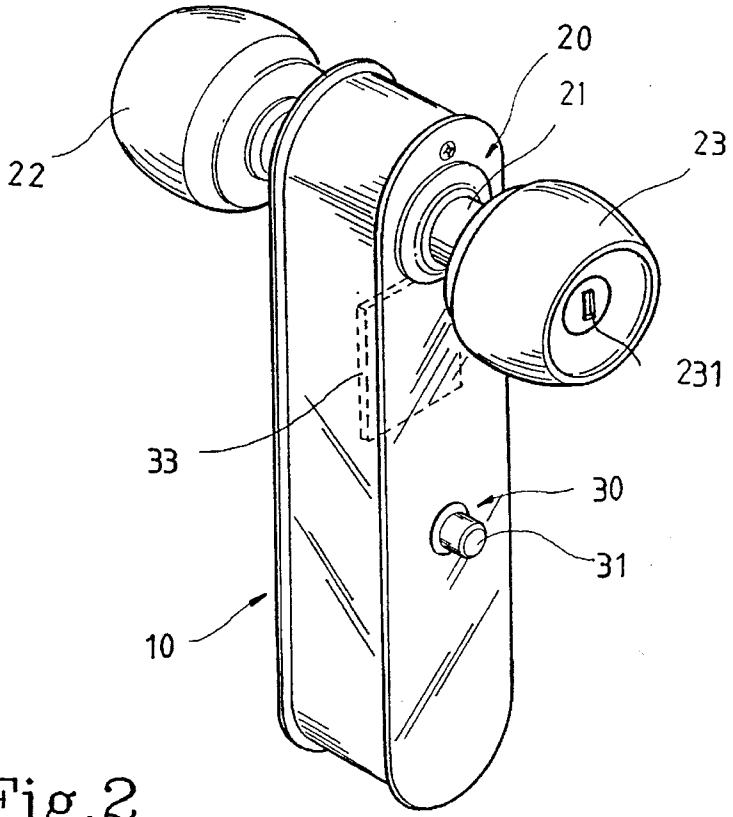
FIG. 2 is an elevational perspective view to show a rear side of the preferred embodiment according the present invention.
Figure 1:
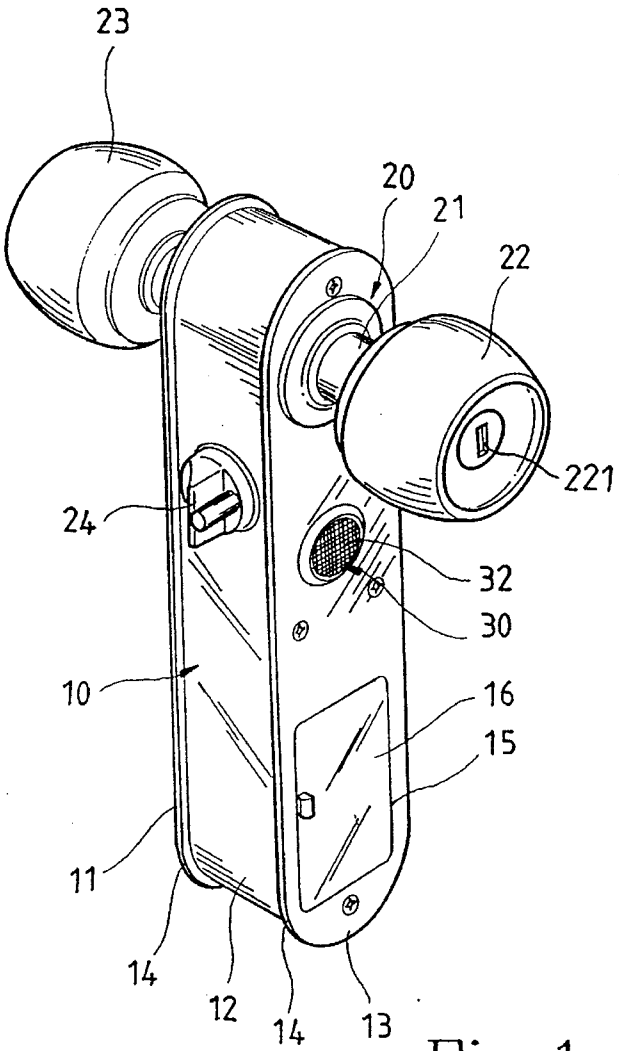
FIG. 1 is an elevational perspective view to show a front side of a preferred embodiment according the present invention.
Figure 3:
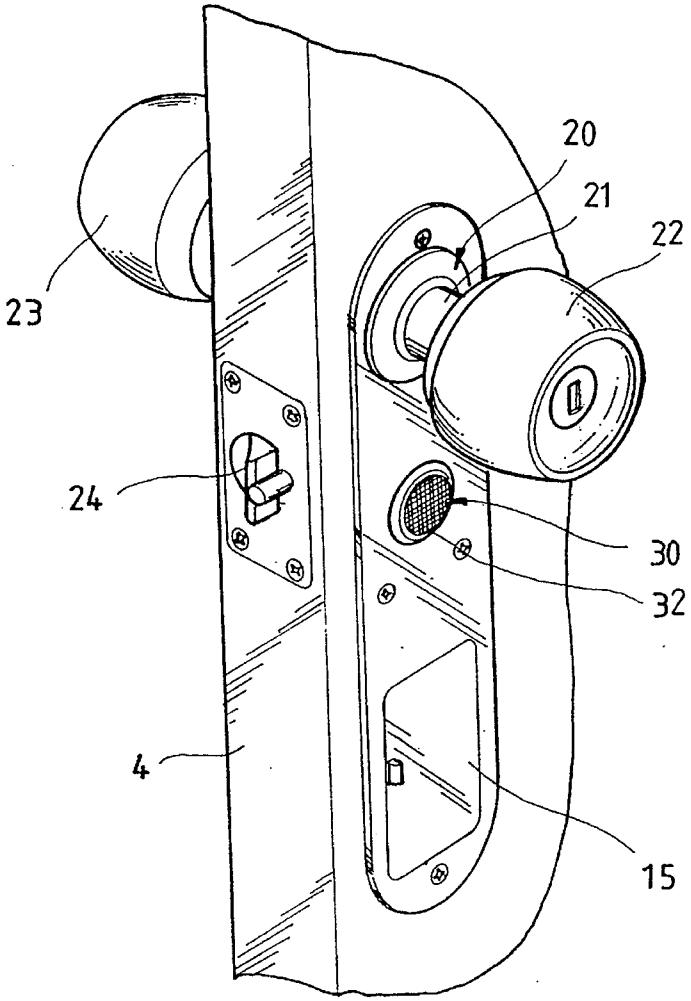
FIG. 3 is an elevational perpective to show a part of a door being secured therein a music door lock assembly according to the present invention.

Referring to FIGS. 1 and 2, the present invention of a musical door lock comprises a generally rectangular housing 10, a door lock 20 disposed in upper portion, an electric door bell 30 in the middle portion and a battery chamber 15 in the lower portion thereof. The housing 10 comprises a two-end arched rectangular bottom 11, encircled wall 12 an a two-end arched rectangular cover 13. Both of the bottom 11 an the cover 13 are formed with flanges 14 extending outward from their edges and a circular recess through their upper portion. The door lock 20 comprises a tubular bar 21 extending transversely and across through the front and the rear peripheries of the housing 10, a pair of hand knobs 22 and 23 rotatably secured on two ends of the tubular bar 21 each having a key aperture 221 and 231 and a spring door latch 24 transversely extruding out from the lateral periphery of the housing 10 and perpendicularly connected with a conventional lock mechanism inside the housing 10. The electric door bell 30 comprises a push-button operatably 31 of secured on the outer periphery of the bottom portion and a speaker 32 secured within the outer periphery of the cover 13 of the housing 10, both connecting to a sound generator 33 disposed inside the middle portion of the housing 10. They are electrically supplied by the batteries inside the battery chamber 15 which is covered by a lid 16 openably secured on the cover 13. FIG. 3 shows a musical door lock assembly secured in place on a door 4 as the spring door latch 24 transversely extends out of pressed by a visitor, the sound generator 33 is actuated to release a melodious sound or of a bird chirping through the speaker 32.

Figures 4A, 4B, 4C:
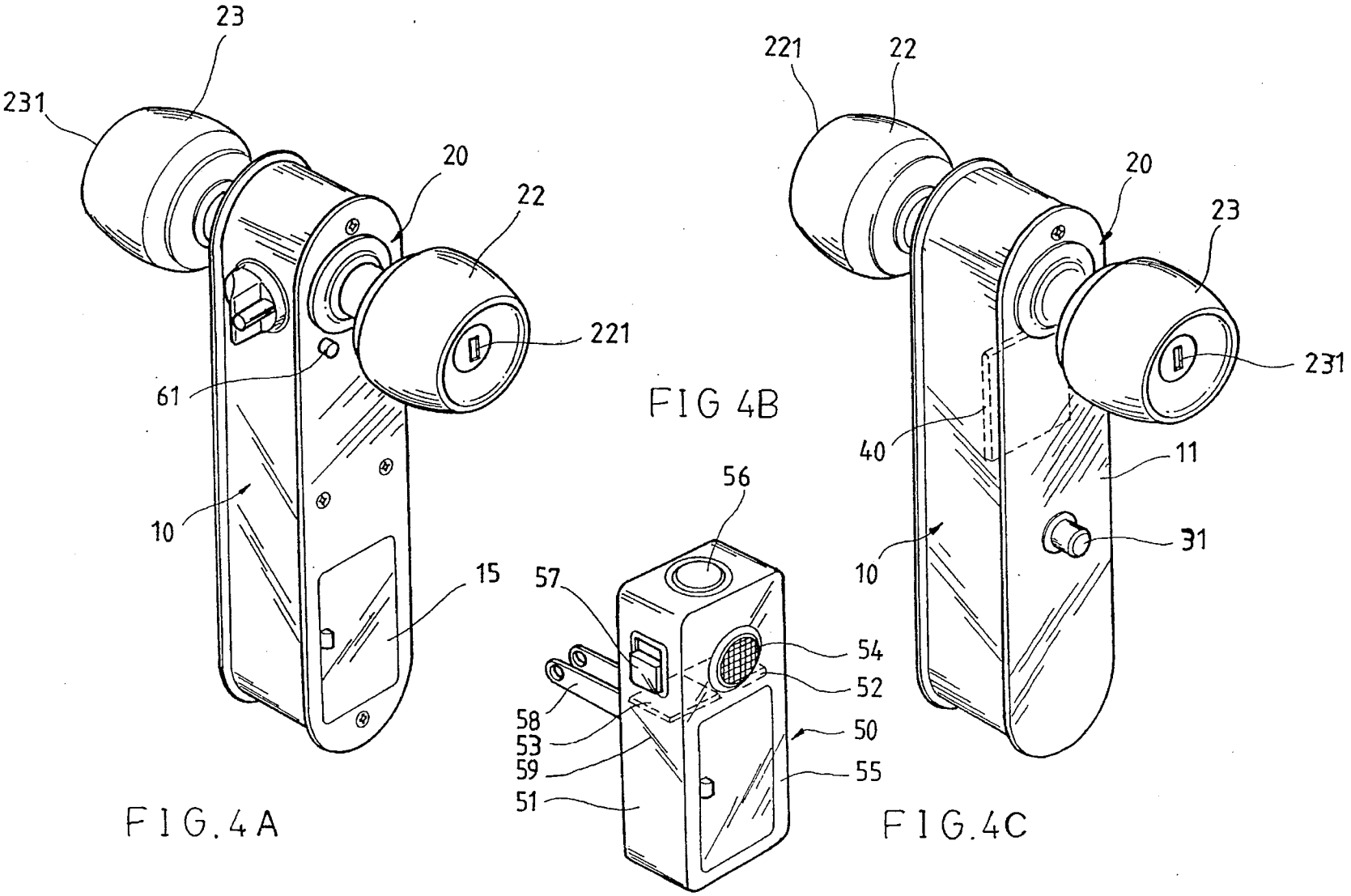
FIG. 4A to 4C are the elevational perspective views to show a preferred embodiment of the second example according to the present invention.

Referring to FIGS. 4A to 4C which show a second example of a radio type musical door lock assembly of the present invention and which comprises generally a frequency regulator 40 disposed instead of a electric door bell 30 inside the housing 10 and a movable wireless door bell 50 enclosed in a rectangular casing 51 in which comprises a frequency receiver 52, a sound generator 53, a speaker 54, a battery chamber 55, a light bulb 56 releasably secured in a tapering groove on the top of the casing 51, a sliding button 57 disposed on a lateral periphery to turn on-off the light bulb 56 and a pair of plug blades 58 extruding out of the rear periphery of the casing 51 which is provided to insert into a wall socket and connected on their inner ends to a transformer 59 which is connected respectively with the battery chamber 55 and other components. This arrangement insures that the movable wireless door bell 50 is normally operated with ac current or can be revertible to de current in case of a power failure. When the push-button 31 on the outer periphery of the door is pressed by the a visitor, the regulator 40 is actuated to give signal at a predetermined frequency to be received by the frequency receiver 52 inside the movable wireless door bell 50 which immediately actuates the sound generator 53 to release a musical melody or of the sound of bird chirps through the speaker 54. The light bulb 56 disposed on the top of the casing 51 is arranged to be used a flashlight in case of a power failure.

Figure 5:
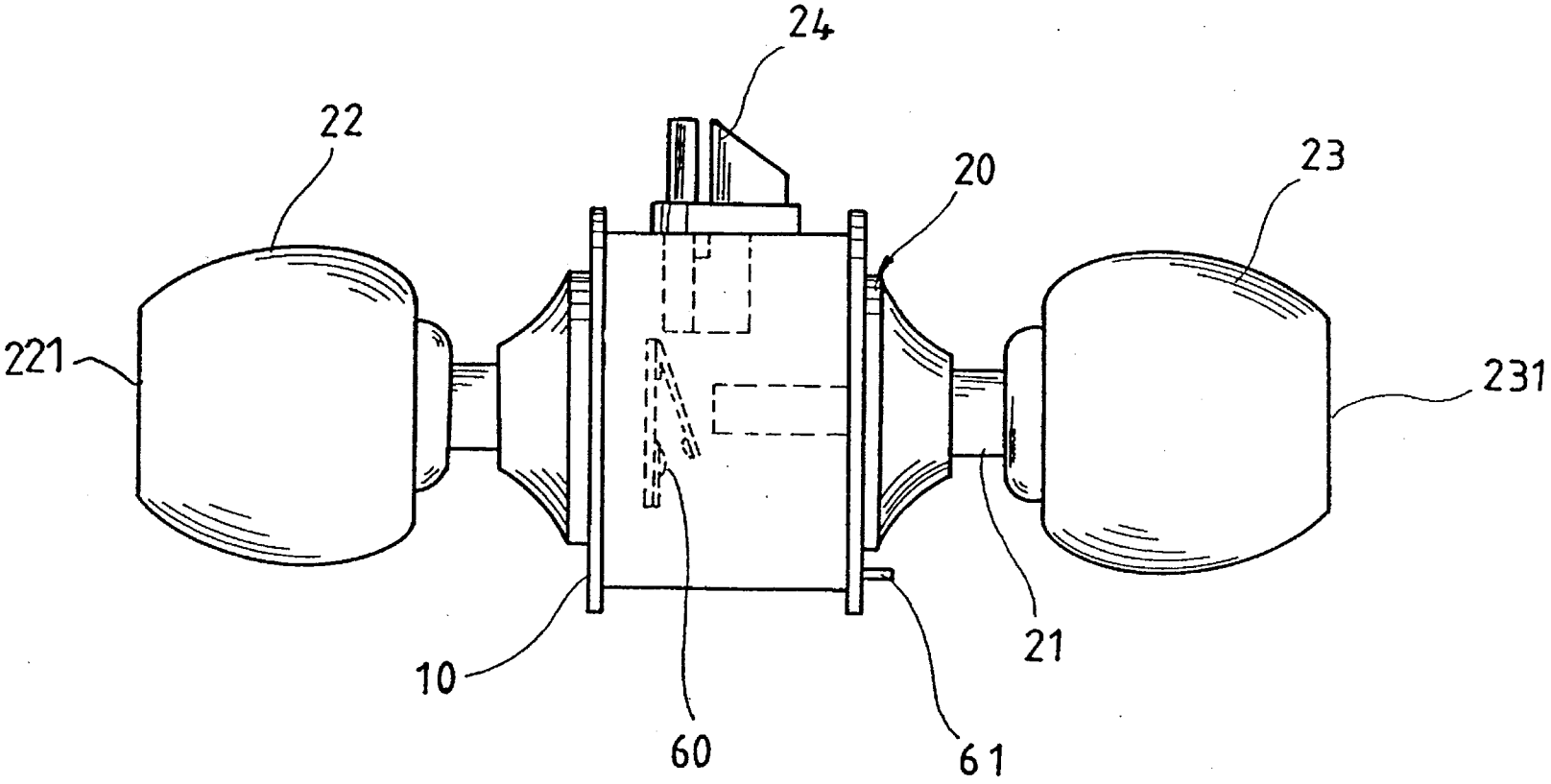
FIG. 5 is a perspective view to show a door lock incorporated inside with a burglar-proof device according to the present invention.

Referring to FIGS. 4A and 5, an anti-burglar device is arranged with the locking mechanism inside the door lock 20 which comprise generally a spring plate 60 and an active/inactive button 61. The spring plate 60 is disposed at the perpendicular point of the spring door latch 24 and the key aperture 231 and connected respectively with the button 61, the battery chamber 15 and either the sound generator 33 or the frequency regulator 40 from the second example of the present invention. This anti-burglar device is actuated by the button 61 on the outer periphery of the cover 13 in he proximity of the hand knob 23 When a key inserts into the key aperture 231 as the button 61 turns on and rotates in the mold of opening or that the latch 24 is moved backward, the spring plate 60 will be touched, actuating the sound generator 33 or the regulator 40 to release a warning sound. A portable receiver (not shown) may be developed to receive the signal of warning remotely in a certain distance Based on aforediscussed embodiment, this invention of a musical door lock is characterized in the following advantages:

1) it provides a door lock combined with musical door bell that saves space in a house to separately install a door lock and a door bell, 2) a movable wireless door bell is developed to facilitate an unrestrained installation of a door bell in the house, 3) an anti-burglar device disposed with a door lock and a light bulb disposed on the top of the movable wireless door bell provide a broader utility for an object, and 4) a portable radio receiver may be adaptable to the anti-burglar device to provide further convenience so as to remotely receive the signal of warning in certain distance.

The scope of this invention should determined by the appended claims and their legal equivalents rather than by the examples given in aforementioned specifications

I claim:

1. A musical door lock comprising a generally rectangular housing having enclosed there in a door lock at an upper portion, an electric door bell at a middle portion and a battery chamber at a lower portion, wherein;

said housing comprising an arched rectangular bottom portion, an encircled wall and an arched cover thereof; both of said bottom portion and said cover having equally formed outward flanges and a circular recess through said upper portion; a push-button disposed through said bottom portion and a speaker disposed on said cover in the proximity of a lid which is formed to cover said battery chamber thereof;

said door lock comprising a tubular bar transverse and cross-extended through said circular recesses on the upper portion of said housing and indirectly connected to a spring door latch transversely extruded from said housing, and a pair of hand knobs secured on two ends of said tubular bar, each having a key aperture formed at the center of their outer peripheries;

said electric door bell comprising sound generator connected respectively with said batter chamber, said push-button and said speaker;

whereby said sound generator is actuated as said push button is pressed to release a musical melody or a sound of bird chirps through said speaker.

2. A musical door lock according claim 1, further comprising an anti-burglar device disposed side said housing and connected with said door lock, said battery chamber and said sound generator respectively.

3. A musical door lock comprising a generally rectangular housing having enclosed therein a door lock at an upper portion, a frequency regulator at a middle portion, a battery chamber at a lower portion and a movable wireless door bell, wherein;

said housing comprising an arched retangular bottom portion, an encircled wall an arched cover thereof; both of said bottom portion and said cover having equally formed outward flanges and a circular recess through said upper portion; a push-button disposed through said bottom portion, a lid formed to cover said battery chamber thereof;

said door lock comprising a tubular bar transverse and cross-extended through said circular recesses on the upper portion of said housing and indirectly connected to a spring door latch transversely extended from said housing and a pair of hand knobs secured on two ends of said tubular bar each having a key aperture formed at the center of their outer peripheries;

said frequency regulator disposed inside the middle portion of said housing being connected respectively with said battery chamber and said push-button;

said movable wireless door bell having a generally rectangular casing comprising a frequency receiver, a sound generator, a transformer, a battery chamber, a speaker, a lid for covering said battery chamber, a light bulb secured in a tapering groove on a top incorporated with a sliding switch on a lateral periphery and a pair of plug blades on a back side of said casing;

whereby said push-button outside a door is pressed to actuate said frequency regulator releasing a signal to be received by said frequency receiver inside said movable wireless door bell, a musical melody or bird chirps being accordingly released out by said sound generator through said speaker on an outer periphery of said casing.

4. A musical door lock according to claim 3, wherein said movable wireless door bell is applicable to ac/dc current so that said light bulb on the top of said casing can be still operatable during a power failure.

5. A musical door lock as recited in claim 3, further comprising an anti-burglar device disposed inside said housing and connects respectively with said door lock, said battery chamber and said frenquency regulator to release a warning signal to be received by said movable wireless door bell.

* * * * *